United States Patent [19]

Uhlig

[11] 4,235,349

[45] Nov. 25, 1980

[54] ONE-PIECE SAFETY CLOSURE FOR RIGID CONTAINERS HAVING A BEAD FINISH

[75] Inventor: Albert R. Uhlig, Toledo, Ohio

[73] Assignee: Owens-Illinois, Inc., Toledo, Ohio

[21] Appl. No.: 67,857

[22] Filed: Aug. 20, 1979

[51] Int. Cl.[3] ..... B65D 43/04

[52] U.S. Cl. ..... 220/281; 220/306; 220/307; 215/211; 215/301; 215/224

[58] Field of Search ..... 220/281, 306, 307; 215/211, 209, 301, 224

[56] References Cited

U.S. PATENT DOCUMENTS

| | | | |
|---|---|---|---|
| 3,782,575 | 1/1974 | Braun | 215/224 X |
| 4,098,418 | 7/1978 | Fields | 220/281 X |

*Primary Examiner*—George T. Hall

*Attorney, Agent, or Firm*—John R. Nelson; Myron E. Click; David H. Wilson

[57] ABSTRACT

A safety closure is provided for closing the open neck of containers having a bead type finish formed on such neck end. The closure comprises a unitary element molded from a resilient plastic material and having a generally horizontal circular panel portion and an integral, generally vertical peripheral flange portion. The flange portion is provided with an internally projecting rib which snaps into engagement with the groove normally provided beneath the bead of a container bead finish. In the closed position of the closure on the container, the bottom edge of the closure flange is flush with the side wall of the container neck and cannot be engaged by the fingers to pry the closure off of the container. The closure can be opened solely by applying a vertical force to a specific rim portion of the closure which causes an underlying specially shaped segment of the lower rim of the closure to be cammed outwardly sufficient to permit a fingernail to be inserted under such segment and the closure can then be stripped from engagement with the neck of the container.

10 Claims, 9 Drawing Figures

ONE-PIECE SAFETY CLOSURE FOR RIGID CONTAINERS HAVING A BEAD FINISH

BACKGROUND OF THE INVENTION

The prior art contains many examples of closures designed to be difficult for children to open, but readily operable by adults capable of reading and following opening instructions. The great majority of such closures, however, have been designed for dispensing of liquids or granulated materials from narrow neck containers and, in many instances, involve the lifting of a locking flap from sealing engagement with one or more dispensing openings formed in the panel of the closure. In the case of wide mouthed containers, the products that are generally sold in such containers normally require the entire closure to be removed from the end of the container to permit proper dispensing of the contents of the container. A prime example is a paint container where the entire lid must obviously be removed from the wide mouthed container opening in order to permit the insertion of a paint brush. Many paints, varnishes and stains contain ingredients that would be harmful to small children if they gained access to them. Accordingly, there is a distinct need for a safety closure for a wide mouthed container which, when the closure is opened, results in the removal of the entire closure from the mouth of the container.

SUMMARY OF THE INVENTION

A safety closure constructed in accordance with this invention is specifically designed for use with a container having a wide mouth neck opening which is surrounded by what is known in the trade as a bead finish. Such bead is normally defined by an external rib on the neck above a radial shoulder, thus defining an annular groove in the outer surface of the neck, and the closure is formed of resilient plastic and provided with a generally vertically extending peripheral flange having an internally projecting rib which snaps into locking engagement with such groove. The safety package embodying this invention provides a vertically flexible bead finish of generally S-shaped configuration in cross section, with the lower loop of the S defining the annular closure retaining groove. The peripheral flange of the closure is then constructed so that the internally projecting rib snugly engages in the groove, but concurrently, the bottom rim portion of the closure flange is maintained in flush relationship with the adjacent side wall of the neck of the container. It is therefore impossible to insert a fingernail under the rim of the closure to effect the removal thereof.

To effect the closure removal, a segment of the internally projecting locking rib on the closure is provided with a vertically inclined bottom surface, instead of the normal horizontal surface. The application of a vertical force to the rim portion of the closure overlying such specially shaped segment will effect a downward depression of the relatively flexible bead finish at that location and the vertically inclined surface segment of the locking rib will be cammed outwardly by engagement with the adjacent edge of the closure retaining groove. This outward displacement of a segment of the closure rim permits a fingernail to be inserted under such segment and the closure to be thereafter stripped from sealing engagement with the container neck.

In a modification of this invention the vertically resilient neck portion of the container is defined by an internally projecting flange which is connected at its inner end with a radially outwardly and upwardly directed flange. The vertex end of such configuration provides an internal locking bead for the closure while the space between such flanges provides the external groove within which the bottom rim portion of the vertical flange of the closure is received.

In accordance with a modification of the invention, the principles of the invention may also be applied to a container having a relatively rigid finish portion. In such modification, sufficient space is provided between the top of the finish and the panel portion of the closure to permit a localized segment of the closure rim to be depressed downwardly through the application of a downward force and the vertically inclined surface provided on the bottom surface of such segment will be cammed outwardly by the adjacent edge of the closure retaining groove.

Further objects and advantages of this invention will be apparent to those skilled in the art from the following description taken in conjunction with the annexed sheets of drawings showing several embodiments of the invention.

DESCRIPTION OF PREFERRED EMBODIMENTS

Figure 1:
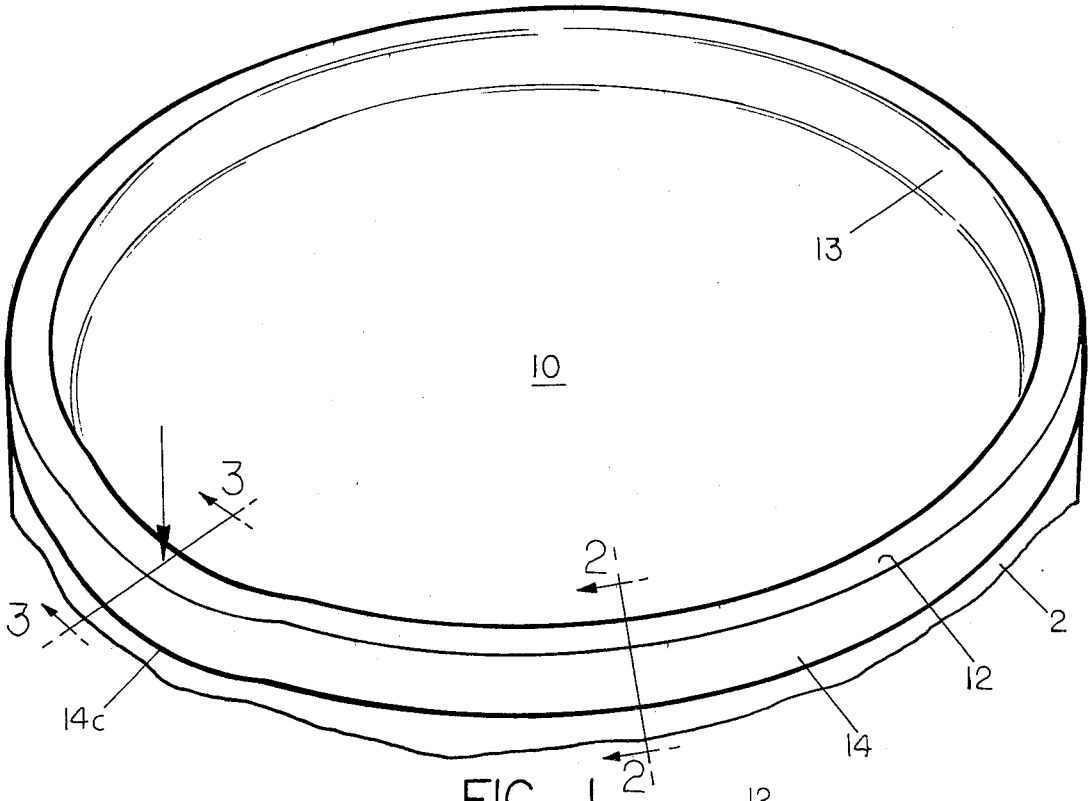
FIG. 1 is a perspective view of a safety package embodying this invention, shown with the closure in assembled relationship to a wide mouth container having an external bead finish.
Figure 2:
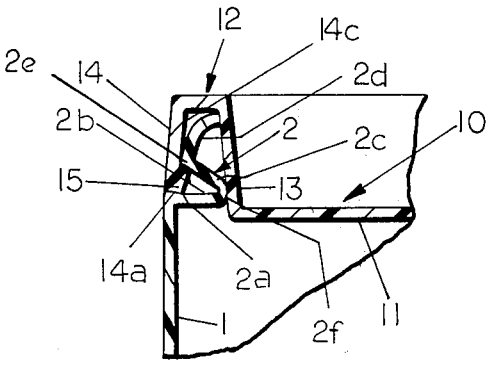
FIG. 2 is a partial sectional view taken on the plane 2—2 of FIG. 1.

FIGS. 1 through 4 of the drawings disclose one embodiment of this invention as applied to a wide mouth container 1 formed of plastic material having some degree of resilience. The neck portion 2 of the container is formed with a corrugated or S-shaped configuration in vertical cross section and includes an inwardly extending flange portion **2*a* defining a generally horizontal top surface 2*b*, an outwardly and upwardly extending flange portion 2*c*, which is joined at its outer end with another inwardly and upwardly extending flange portion 2*d*. The vertex 2*e* of portions 2*c* and 2*d*** defines an external closure retaining bead. The formation of the top end of the container neck in the described corrugated or S-shaped configuration obviously provides some degree of vertical flexibility to this portion of the container neck.

The closure 10 constructed in accordance with this invention is formed as an integral member molded from a resilient plastic material and comprises a generally circular panel portion 11 connected at its periphery to a flange portion 12 which is generally vertically disposed and is of inverted U-shape in cross section so as to snugly surround and engage the vertically flexible S-shaped neck portion. The inner wall 13 of the U-shaped vertical flange 12 abuts the end of neck flange 2*d* and the vertex 2*f* formed by the juncture of flanges 2*a* and 2*c*. The outer wall 14 of the vertical U-shaped flange 12 has an internally projecting rib 15 adjacent its lower rim portion which is contoured to fit in locking engagement beneath the vertex or bead 2*e* formed by the juncture of container neck flanges 2*c* and 2*d*. Additionally, the outer wall 14 is provided with a generally horizontal bottom surface 14*a* which snugly engages the upwardly facing surface 2*b* of the inwardly directed neck flange 2*a*. In this position, the surface of outer flange 14 is flush with the adjacent surface of the container neck 2. It is therefore impossible for a fingernail to be inserted underneath the lower rim of flange portion 14 to attempt to cam such rim to an unlocking position. For additional security, the radially outer portions of neck surface 2*b* may be slightly upwardly inclined. This presents inadvertent opening under top loading conditions.

Figure 3:
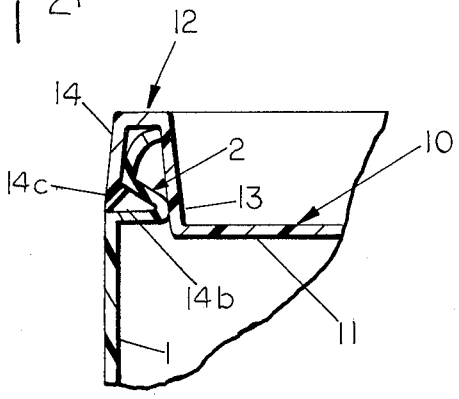
FIG. 3 is a partial sectional view taken on the plane 3—3 of FIG. 2.
Figure 4:
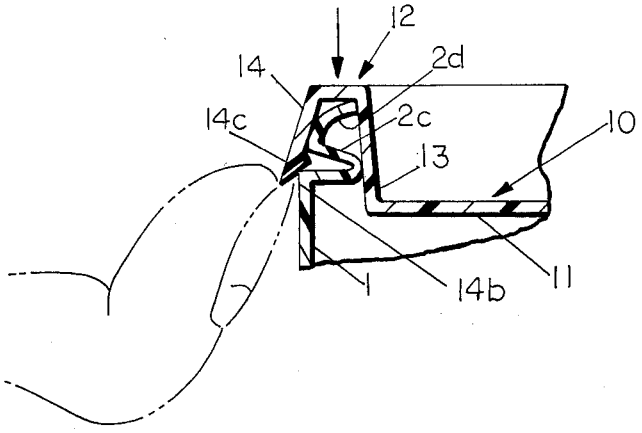
FIG. 4 is a view similar to FIG. 3 but showing the utilization of a fingernail inserted beneath the outwardly displaced segment of the closure rim to effect the stripping of the closure from the container.

In accordance with this invention, and as best illustrated in FIGS. 3 and 4, a limited accurate segment portion of the bottom surface 14*a* is provided with an upwardly inclined surface 14*b*. Because of the provision of such inclined segment surface, the application of a downward force to the flange 12 at a position overlying the inclined surface segment 14*b* will first effect a vertical compression or vertical folding of the neck flanges 2*c* and 2*d*. This will bring the inclined bottom surface segment 14*b* into engagement with the angular edge defined between the horizontal neck flange 2*a* and the vertical neck wall. As illustrated in FIGS. 1 and 4, this will result in a limited arcuate segment 14*c* of the bottom rim portion of the outer vertical flange wall 14 being displaced from its flush relationship with the side walls of the container neck 2, permitting a fingernail to be inserted under such outwardly displaced segment and sufficient force applied to the closure 10 to strip it from its sealing engagement with the container neck 2.

It will be recognized that the possibility of the closure being inadvertently removed from its closed position on the container is practically negligible. While the banging of the closure against a solid object may produce a momentary outward deflection of the wall segment 14*c*, if this is not concurrently followed by the insertion of the fingernail under the displaced wall segment, such wall segment promptly returns to its original flush position with respect to the container wall by its inherent resilience and the security of the closure remains undisturbed. Only the conscious application of a downward force to the particular rim area of the closure overlying the segment having the inclined bottom wall surface 14*b*, concurrent with the insertion of the fingernail under the slightly projecting rim portion 14*c* of that segment of the closure will effect the stripping of the closure from the container. Obviously, the required sequence of operations is beyond the capability of a child.

Figure 5:
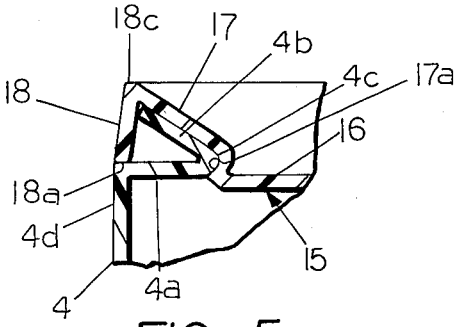
FIG. 5 is a partial vertical sectional view showing a modified safety package embodying this invention wherein the neck portion of the container has an internal bead finish.
Figure 6:
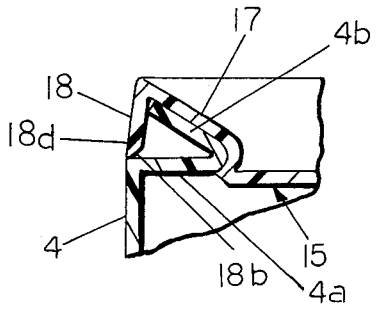
FIG. 6 is a view similar to FIG. 5 but showing the configuration of a selected portion of the container rim to which an opening force is applied.
Figure 7:
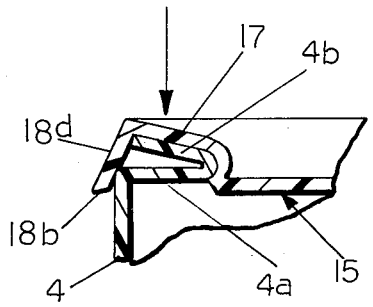
FIG. 7 is a view similar to FIG. 6 but illustrating the outward camming of the rim segment of the closure through the application of a downward force to the top rim of the closure.

Referring now to the modification of this invention illustrated in FIGS. 5 through 7, the vertically flexible container neck 4 is shown as having only an inwardly directed horizontal flange 4*a* connected at its inner end with an outwardly and upwardly directed flange 4*b*, the vertices of the flanges 4*a* and 4*b* defining an internal locking bead 4*c*. The closure 15 includes a horizontal circular panel portion 16, to the perimeter of which is secured a generally inverted U-shaped flange 17 having a short vertical inner wall defining a groove 17*a* to snugly receive the internally projecting bead 4*c*, and an outer vertical wall 18 which has a generally horizontal bottom rim surface 18*a* engaging the top of the horizontal flange 4*a* so that the external surface of the outer flange 18 is essentially flush with the external neck wall 4*d*.

A relatively small peripheral segment of the outer flange wall 18 has its bottom surface formed as an upwardly inclined surface 18*b* as shown in FIG. 6. It follows then that the application of a vertical force to the top surface 18*c* of the outer flange 18 at a point located directly above the location of the inclined bottom surface segment 18*b*, produces an outward deflection of that segment 18*d* of the rim of the outer wall flange 18 by the camming action of surface 18*b* on the shoulder between flange 4*a* and side wall 4.

Again, it takes the application of a downward force to a very specific area of the rim of the closure 4 to effect an outward deflection of only a segmental portion of such rim sufficient to permit a fingernail to be engaged under the outwardly deflected portion 18*d* to effect the upward stripping of the closure from the container.

The principles of this invention may also be applied to metal, glass or plastic containers having relatively rigid neck portions. Referring now to the modification shown in FIGS. 8 and 9, the container neck 6 is shown as comprising a horizontal inturned flange portion 6*a*, connected to a vertical flange portion 6*b* which has an enlarged outer rim portion 6*c* on its top end, thereby defining a groove 6*d* for reception of a correspondingly shaped internal rib 22*a* formed on the bottom of a vertical flange portion 22 of a closure 20. Flange portion 22 is integrally connected to a panel portion 21 and is radially spaced from a depending flange portion 23 which snugly engages the inner vertical wall of the container vertical flange 6*b*.

Figure 8:
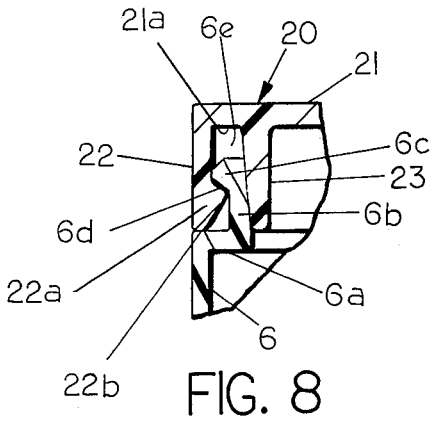
FIG. 8 is a partial vertical sectional view of a safety package embodying this invention wherein the container finish is relatively rigid.
Figure 9:
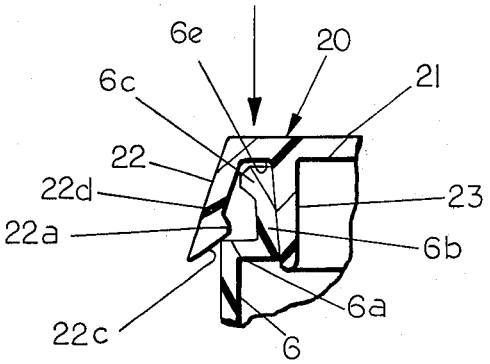
FIG. 9 is a view similar to FIG. 8 but illustrating the outward camming of a segment of the rim of the closure through the application of a downward force to the top rim of the closure.

The total height of the vertical flange portion 22 is selected to be in excess of the height of the vertical container flange 6*b* so that a space 6*e* is defined between the bottom wall 21*a* of the panel portion 21 and the top wall of the bead defining portion 6*c* of the container finish. Since the neck 6 has been assumed to be relatively rigid, it is readily apparent that no downward displacement of the closure 20 relative to the neck 6 can occur if all of the bottom surface 22*b* of the vertical flange 22 is horizontally shaped as shown in FIG. 8. However, as illustrated in FIG. 9, a limited angular segment 22*d* of the outer vertical flange 22 is provided with an upwardly inclined bottom surface 22*c*. When a downward force is applied to the rim of closure 20, immediately above the inclined surface segment 22*c*, the result will be an outward displacement of the rim segment 22*d* containing the inclined surface 22*c*, as illustrated in FIG. 9, permitting the fingernail of the person opening the container to be inserted under the projecting rim portion of the closure 20 to effect the stripping of the closure from the container 6.

From the foregoing description, those skilled in the art will recognize that modifications of this invention may be readily made without departing from the fundamental principles involved in the invention, and it is intended that the scope of the invention be determined solely by the appended claims.

I claim:

1. A safety package comprising a container having an annular vertical neck defining a generally horizontal external shoulder spaced below the end of the neck, a closure molded from a resilient plastic material, said closure having a generally horizontal circular panel portion and a generally vertical flange portion surrounding the container neck and having a horizontal, annular bottom rim surface abutting said horizontal shoulder, cooperating surfaces on said closure and container neck for securing the closure thereon in sealing relationship, said cooperating surfaces permitting downward movement of said closure relative to said neck, and a segment of said closure bottom rim surface being sloped upwardly and inwardly, whereby the application of a vertical downward force to the top rim surface of the closure only at a region overlying said inclined surface segment will produce an outward bulging of a segment portion of said vertical flange beyond the extremity of said horizontal shoulder on said container neck.

2. The safety package defined in claim 1 wherein the container is formed of a resilient material and that portion of the container neck above said horizontal shoulder is of corrugated configuration in cross-section, thereby permitting a localized downward deflection under the influence of said downward force applied to the vertical flange of the closure.

3. The safety package defined in claim 1 wherein the panel portion of said closure adjacent the vertical flange portion is spaced above the container neck rim, thereby permitting a localized downward deflection under the influence of said downward force applied to the vertical flange of the closure.

4. A safety closure for containers having a finish defining a closure retaining bead and a generally radial shoulder below the bead, comprising a one-piece circular element molded of resilient plastic material, said element including a horizontal disc-like panel portion and a generally vertical peripheral flange portion constructed and arragned to fit snugly around the container finish in locking relationship thereto, the lower rim of said flange portion being generally radial and constructed and arranged to abut the container shoulder in the closed position of the closure, whereby none of the closure rim can be engaged by a fingernail, a segment of said vertical flange having a vertically inclined bottom surface engageable with the edge of the container shoulder to produce an outward camming of said flange segment upon the occurrence of downward movement of the flange segment relative to the container, whereby the application of a downward force only to the portion of said flange overlying said segment effects an outward camming of a rim segment of the lower end of said flange beyond the container shoulder, thereby permitting fingernail engagement with such rim segment to strip the closure off the container finish.

5. A safety closure for containers having a bead finish and a generally radial plane shoulder beneath the bead, comprising a one-piece circular element molded of resilient plastic material, said element including a horizontal disc-like panel portion and a generally vertical peripheral flange portion constructed and arranged to fit snugly around a container bead finish, said peripheral flange having an internally projecting rib constructed and arranged to lockingly engage the container bead finish, the bottom rim portion of said flange being generally radial and constructed and arranged to abut the container shoulder in the locked position of the closure, whereby none of the closure rim can be engaged by a fingernail, and a segment of said flange having a vertically inclined bottom surface, whereby the application of a downward force only to the portion of said flange overlying said segment effects an outward camming of a rim segment of said flange beyond the container shoulder, thereby permitting fingernail engagement with such rim segment to strip the closure off the container finish.

6. A child resistant package comprising:

(1) A container having a vertically resilient, annular neck closure securement bead and a groove formed in its external surface with the bottom wall of the groove defining a generally radial shoulder;

(2) A closure comprising a one-piece circular element molded of resilient plastic material, said element including a horizontal disc-like panel portion and a generally vertical peripheral flange portion constructed and arranged to fit snugly around the said container neck;

(3) Said peripheral flange having a lower radial rim portion constructed and arranged to abut the container radial shoulder in the closed position of the closure, whereby none of the closure rim can be engaged by a fingernail, and (4) Said rim portion having a vertically inclined bottom surface on a limited peripheral segment thereof, whereby the application of a downward force only to that portion of the closure overlying said rim segment effects an outward camming of said rim segment beyond the container shoulder, thereby permitting fingernail engagement with such segment to strip the closure off the container neck.

7. The safety package defined in claim 6 wherein the resiliently flexible annular neck of the container is of corrugated configuration in vertical cross section, permitting the downward deflection of a portion of the neck through the application of a vertical force thereto.

8. The package defined in claim 6 wherein said vertically resilient annular neck of the container is of generally S-shaped configuration in vertical cross-section, the loop portions of the S-shaped configuration being compressible on the application of a vertical force thereto.

9. The safety closure defined in claim 6 wherein said vertically resilient neck of the container comprises a generally horizontal inwardly projecting flange defining said radial shoulder, and a second flange extending radially outwardly and upwardly from the inner end of said horizontal flange to define said closure securement bead.

10. A safety closure for containers having a bead finish and a generally radial shoulder beneath the bead comprising a one-piece circular element molded of resilient plastic material, said element including a central disc-like panel portion and a peripheral flange portion of inverted U-shaped cross section constructed and arranged to fit snugly around the container bead finish, the outer leg of said U-shaped cross section having an internally projecting rib constructed and arranged to engage the container bead finish below the bead, the bottom surface of said rib being generally radial and constructed and arranged to abut the container shoulder in the closed position of the closure, whereby none of the closure rim can be engaged by a fingernail, a segment of said radial bottom surface being upwardly inclined, whereby the application of a downward force only to a portion of the outer rim of said flange overlying said segment effects an outward camming of a segment of said outer leg beyond the container shoulder.

* * * * *